US007076925B2

(12) United States Patent
Gagliano

(10) Patent No.: US 7,076,925 B2
(45) **Date of Patent: *Jul. 18, 2006**

(54) INTEGRATED FOOTINGS

(75) Inventor: Richard Gagliano, Gig Harbor, WA (US)

(73) Assignee: PIN Foundations, Inc., Gig Harbor, WA (US)

( * ) Notice: Subject to any disclaimer, the term of this patent is extended or adjusted under 35 U.S.C. 154(b) by 105 days.

This patent is subject to a terminal disclaimer.

(21) Appl. No.: 10/362,838

(22) PCT Filed: Jul. 24, 2001

(86) PCT No.: PCT/US01/23287

§ 371 (c)(1),
(2), (4) Date: Jul. 23, 2003

(87) PCT Pub. No.: WO02/18712

PCT Pub. Date: Mar. 7, 2002

(65) Prior Publication Data

US 2004/0025450 A1 Feb. 12, 2004

Related U.S. Application Data

(63) Continuation-in-part of application No. 09/651,899, filed on Aug. 30, 2000, now Pat. No. 6,578,333.

(51) Int. Cl.
*E02D 27/50* (2006.01)
*E04G 11/00* (2006.01)

(52) U.S. Cl. ..... 52/155; 52/295; 52/426; 52/699; 249/34

(58) Field of Classification Search ..... 52/155, 52/169.9, 742.14, 293.1, 294, 295, 424, 425, 52/426, 565, 699, 700, 701; 249/18, 33, 249/34, 38, 39, 40; 405/227, 229, 230, 232, 405/244

See application file for complete search history.

(56) References Cited

U.S. PATENT DOCUMENTS

| | | | | |
|---|---|---|---|---|
| 979,474 | A | 12/1910 | Goldsborough | |
| 1,238,384 | A | 8/1917 | Blumenthal | |
| 1,334,053 | A | 3/1920 | Reynolds | |
| 1,407,196 | A | 2/1922 | Johnson | |
| 1,762,341 | A | 6/1930 | McPherson | |
| 1,783,713 | A | 12/1930 | Holman | |
| 1,808,633 | A | 6/1931 | Carver | |
| 2,001,719 | A | 5/1935 | Greene | |
| 2,221,325 | A | 11/1940 | Holman | |
| 2,251,775 | A | 8/1941 | Arrighini | 25/131 |
| 2,610,380 | A | 9/1952 | Pollman | |
| 2,614,311 | A | 10/1952 | Shook | |
| 2,661,517 | A | 12/1953 | Findley | |
| 2,815,778 | A | 12/1957 | Holman | |

(Continued)

FOREIGN PATENT DOCUMENTS

| | | |
|---|---|---|
| CA | 2036832 | 5/1999 |

(Continued)

*Primary Examiner*—Robert Canfield
(74) *Attorney, Agent, or Firm*—Morgan, Lewis & Bocklus LLP; Steven D. Underwood, Esq.

(57) ABSTRACT

A low impact foundation system requiring little or no excavation, and allowing for the preservation of soil and drainage characteristics of the site upon which it is erected. The system utilizes small obliquely driven piles in combination with footing or otherwise footing components designed to engage a foundation wall and replace the common footing typically constructed below such walls.

28 Claims, 7 Drawing Sheets

U.S. PATENT DOCUMENTS

| | | | | | |
|---|---|---|---|---|---|
| 2,826,281 | A | | 3/1958 | Johnson | |
| 2,964,145 | A | | 12/1960 | Clatfelter | |
| 3,216,159 | A | | 11/1965 | Rooker | |
| 3,378,968 | A | | 4/1968 | Shoemaker | |
| 3,524,322 | A | | 8/1970 | Pogonowski | |
| 3,572,044 | A | | 3/1971 | Pogonowski | |
| 3,613,323 | A | * | 10/1971 | Hreha | 52/169.5 |
| 3,969,852 | A | | 7/1976 | Krings | |
| 4,659,256 | A | | 4/1987 | Bullivant | |
| 4,706,921 | A | | 11/1987 | Paulin | |
| 4,767,241 | A | | 8/1988 | Wells | |
| 5,011,336 | A | | 4/1991 | Hamilton et al. | |
| 5,039,256 | A | | 8/1991 | Gagliano | 405/244 |
| 5,120,162 | A | | 6/1992 | Parker | |
| 5,145,291 | A | | 9/1992 | Bullivant | |
| 5,174,083 | A | | 12/1992 | Mussell | |
| 5,224,799 | A | * | 7/1993 | Parker | 405/229 |
| 5,395,184 | A | | 3/1995 | Gagliano | |
| 5,399,050 | A | | 3/1995 | Jacobus | 405/229 |
| 5,406,758 | A | | 4/1995 | Baum | |
| 5,586,416 | A | | 12/1996 | Hess, III et al. | |
| 5,724,773 | A | * | 3/1998 | Hall | 52/34 |
| 5,830,378 | A | | 11/1998 | Butler | 249/18 |
| 5,884,439 | A | | 3/1999 | Hess, III et al. | |
| 5,910,087 | A | | 6/1999 | Carter | |
| 5,924,264 | A | | 7/1999 | Vierra | 52/741.15 |
| 6,578,333 | B1 | | 6/2003 | Gagliano | |

FOREIGN PATENT DOCUMENTS

| | | |
|---|---|---|
| DE | 665988 | 10/1938 |
| FR | 1080764 | 12/1954 |
| FR | 1089334 | 3/1955 |
| FR | 2 639 392 | 11/1988 |
| GB | 243956 | 12/1925 |
| WO | WO 02/18712 | 3/2002 |

* cited by examiner

INTEGRATED FOOTINGS

This application is a 371 of PCT/US01/23287 filed Jul. 24, 2001 which is a CIP of U.S. application 09/651,899 filed Aug. 30, 2000 and which has issued as U.S. Pat. No. 6,578,333.

BACKGROUND OF THE INVENTION

1. Field of the Invention

The present invention generally relates to apparatus and methods for the support of surface structures. More specifically, the present invention relates to improved foundation footings, which provide for minimally intrusive foundation systems.

2. State of the Art

The construction of surface structures invariably involves the preliminary task of building a foundation to support the structure. Most foundations prepared in current practice are comprised of a wall, and a load-bearing base known as a footing. The footing is site poured with a cementitious material into an excavation substantially below grade. The excavation provides for the footing to be founded on competent bearing soils beneath regional frost lines. Once cured, forming boards and a grid of internal reinforcing are constructed on top of the footing, allowing for the subsequent pouring of a cementitious material to form a wall rising out of the excavation to a desired height above grade.

The impetus to install foundations that have minimal environmental impact has become prevalent in many areas. The effects of site manipulation on undisturbed soil are permanent and not restricted to the individual sites on which they occur. "Improving" a site with the use of large machinery, extensive excavation and fill techniques, and the altering of drainage patterns and water tables damages the biological make up, structural integrity, and pre-existing drainage characteristics of the site, the soil, and the surroundings. This in turn can have damaging effects "downstream", where the accumulation of unwanted eroded material in streambeds can alter plant and animal habitats. Man-made systems designed to replace the storage and filtering function of previously undisturbed soils by capturing unwanted drain waters and releasing them slowly back to stream systems can starve the watershed of historic flow patterns, again causing damage to the environment and water quality.

Innovation in foundation design and construction must consider not only low environmental impact, but also economical construction, which is adaptable to the widest possible range of architectural typologies. For low impact construction systems to have significant effects toward improving the environment, and ensuring the sustainability of our population and its building techniques, their use must be widespread and quickly adoptable into the mainstream of current development practices.

U.S. Pat. No. 5,039,256, discloses systems that rectify many of the environmental problems discussed above. The disclosure of U.S. Pat. No. 5,039,256 is hereby incorporated by reference.

OBJECTS OF THE INVENTION

An object of this invention is to provide an improved foundation system that relies on improved load bearing footings.

Another object of this invention is to provide an improved foundation system implementing leveling techniques including step-down configurations of the foundation sill.

Another object of this invention is to provide an improved foundation system that avoids the need for special wood framing techniques in the construction of the surface structure to correct for a sloping foundation sill.

Another object of this invention is to provide a new footing component to provide an improved foundation system.

Another object of this invention is to provide a new method for constructing structural foundations, which utilizes footing components set between wall forms.

Another object of this invention is to provide a new method for constructing structural foundations, which utilizes footing components set between standard wall forms.

Another object of this invention is to provide a new method for constructing structural foundations, which utilizes footing components that slip entirely within wall forms.

Another object of this invention is to provide a new method for constructing structural foundations, which utilizes footing components that slip entirely within standard wall forms.

Another object of this invention is to provide a new method for constructing structural foundations which utilize footing components light enough for an installer to carry and position on site.

Another object of this invention is to provide a new method for constructing structural foundations, which is applicable to a wide variety of site and soil conditions.

Another object of this invention is to provide a new method for constructing structural foundations, which is applicable to a wide variety of architectural typologies.

Another object of this invention is to provide a foundation, which is applicable for uniformly or non-uniformly distributed loading conditions, and concentrated or point loading conditions.

Another object of this invention is to provide a foundation, which is applicable for retaining wall load conditions.

Another object of this invention is to provide a foundation, which is applicable for decorative cementitious wall applications, supporting their own weight.

A further object of this invention is to provide a method and apparatus for constructing a foundation system, which requires substantially less resources than current methods require.

A further object of this invention is to provide a method and apparatus for constructing a foundation system, which will require substantially less or no site excavation for buildings.

A further object of this invention is to provide a method and apparatus for constructing a foundation system without significantly damaging or altering the moisture content, drainage characteristics, biological make-up, or structural integrity of the soil it engages.

It is also an object of this invention to provide a foundation system, which has parts that are easily maintained and/or replaced.

It is also an object of this invention to provide a foundation system, which can be applied repeatedly as a standardized construction component with a specific load bearing capacity, and structural function.

SUMMARY OF THE INVENTION

The above and other objects of the present invention are embodied in a series of footing components used in combination with driven piles, compressible drain bed, and above-grade wall components of a foundation. The current invention is constructed at grade without any or only a very minimal excavation. The present invention expands on the inventions disclosed in U.S. Pat. No. 5,039,256 and provides a low impact footing system that can be integrated directly with foundation walls, thereby eliminating the traditional subsurface footing. The resulting foundation uses less material than traditional foundation assemblies, and is more easily implemented on site by construction personnel.

The present invention provides a footing component for use in constructing a foundation for a structure, including a first vertical wall, with at least one passageway, a second vertical wall with at least one passageway, and wherein the second wall is spaced from and substantially parallel to the first wall. Additionally included is at least one pile, for being driven into the ground through at least one passageway of the first wall and/or at least one passageway of the second wall, and a connector, for connecting the first wall and the second wall, in order to enhance positional retention of the first wall and the second wall and to provide at least one space between the first wall and the second wall for accommodating foundation material.

The first embodiment of the present invention provides a series of footing components that contain openings with sleeves for receiving driven piles, and a central passageway within which a foundation wall is engaged. The piles, which reach to the appropriate soil bearing strata, are driven through the sleeves, preferably at an angle, and to depths determined by specific loading criteria. Each component includes two halves separated by a predetermined distance relative to the width of the foundation wall it is to engage. These two halves are held at the predetermined separation by the driving sleeves, which are in turn held in their respective positions by the material of the two halves. The sleeves are further restricted in this position by a reinforcing element that engages both the sleeves and the halves. The resulting assembly provides a structure for the positioning of the piles and, in conceit with them, becomes a load bearing element that when used in series can be integrated with a foundation wall. When properly aligned and spaced according to the loading criteria of the structure to be supported, the series of integrative footings, provides a framework for the placement of the horizontal members of the wall-reinforcing grid for the erection of the foundation framework and for the subsequent site pouring of a cementitious material for the wall.

The second embodiment of the present invention provides a series of footing components that contain openings with sleeves for receiving driven piles, which components are preferably configured in a specific shape and dimension around which a foundation wall may be constructed. As in the first embodiment, the piles, which reach to the appropriate soil bearing strata, are driven through the sleeves, preferably at an angle, and to depths determined by specific loading criteria. Each component includes two faceplates separated by a predetermined distance relative to the width of the foundation wall it is to engage. These two faceplates are held at this predetermined separation by an interior or anterior plate, preferably substantially perpendicular to the faces, and shaped to allow for the subsequent positioning of longitudinal reinforcing bars in the foundation wall and the proper flow of cementitious material. The faceplates engage and fix the sleeves, which are at opposing angles relative to corresponding openings in the faceplates. The resulting assembly provides a structure for the positioning of the piles, and, in concert with them, becomes a load bearing element, that when used in series, can be fitted entirely within the wall forms for a cementitious foundation wall, and integrated with it.

With the addition of a compressible drain bed required in some applications, the entire assembly, of either the first or second embodiment, provides a low impact foundation, installed without, or with only minimal, excavation. The base of the intended surface structure is attached to the top or sill of the resulting foundation using any appropriate conventional connection method. Once attached the surface structure will rest directly on the formed foundation, transferring its loads through the wall and its engaged pile based components into the load-bearing soils below. The entire assembly is also applicable to both retaining and decorative foundation wall applications. The grouping of driven piles in specific geometric configurations and their relationship to the components, integrated into a continuous foundation wall, according to a specific alignment and spacing, relates directly to the loading characteristics and capacity of the system. The present invention, through its design, ensures that these relationships remain fixed, allowing the entire assembly to resist gravitational, lateral and uplifting forces as each application demands.

The foregoing features of the present invention are more fully described in the following detailed discussion of specific illustrative embodiments thereof, and in conjunction with the accompanying drawings.

BRIEF DESCRIPTION OF THE PREFERRED EMBODIMENTS

Figure 4:
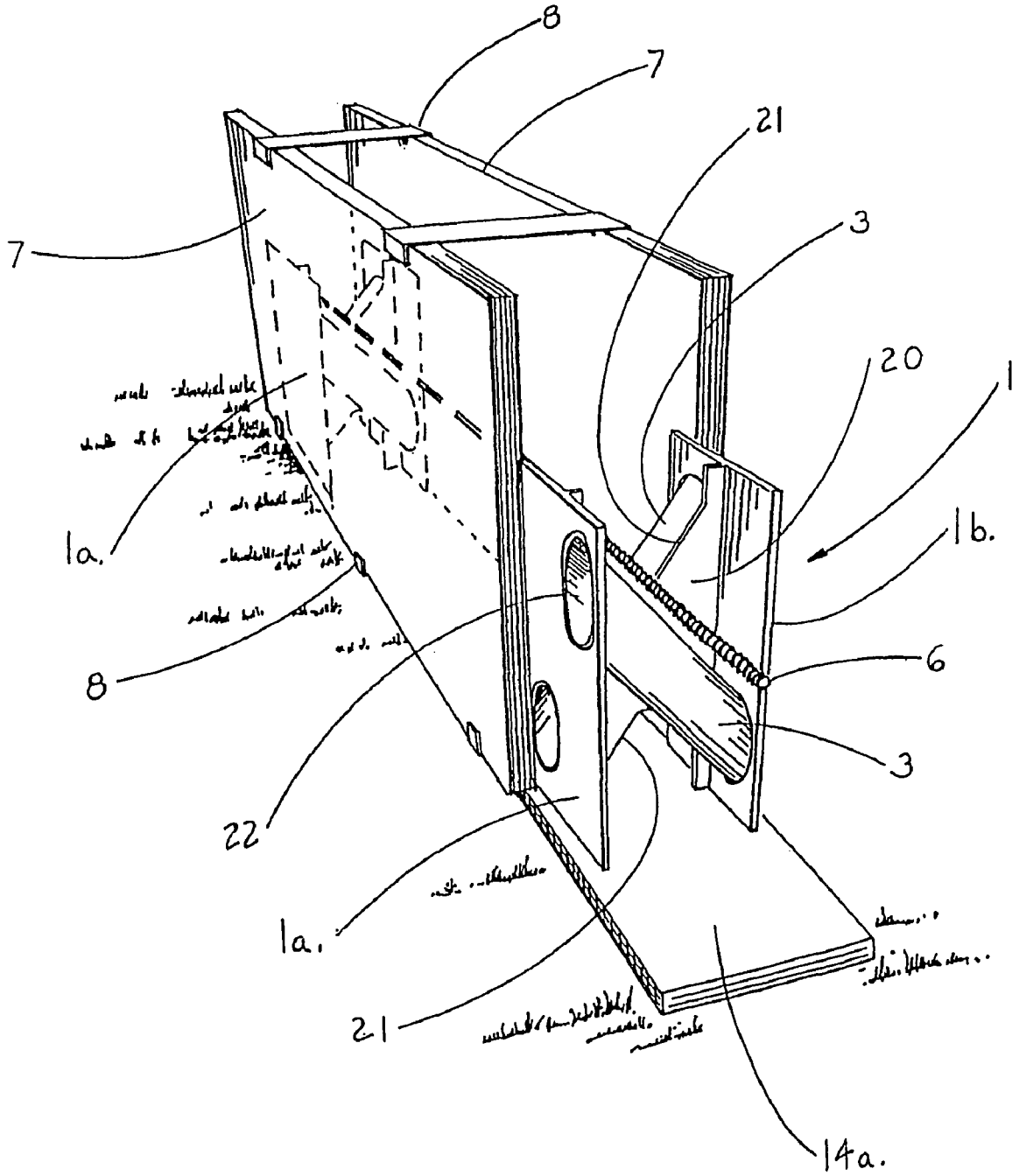

FIG. 4 is a perspective view of a second embodiment depicting two of the footing components arranged in series, and providing for the subsequent positioning of driven piles, and common reinforcing bar. The standard cementitious wall forms enclose the components on either side, against the faceplates. The cementitious material that forms the wall has not yet been poured.

Figure 5:
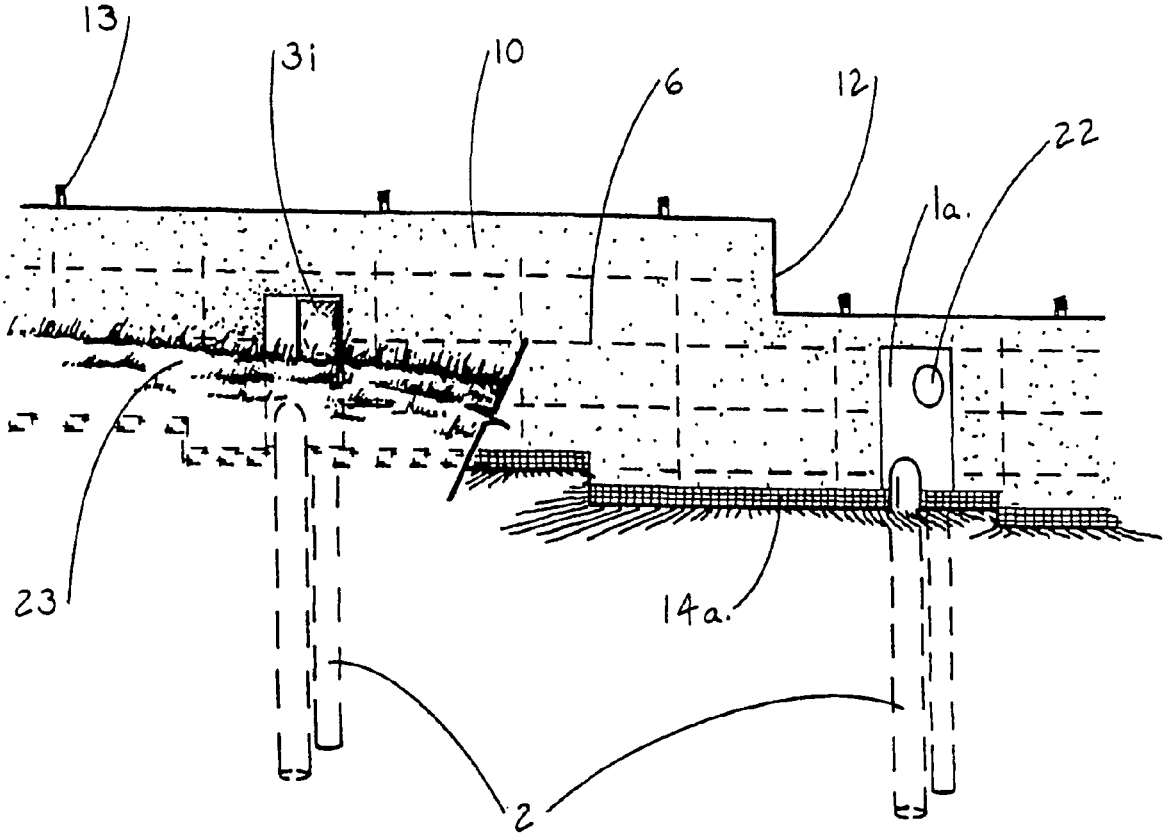

FIG. 5 is a front view of the second embodiment depicting a portion of the assembly of FIG. 4 now fully integrated with the piles fully driven, and the engaged cementitious wall cast and its forms removed. The completed foundation assembly sits on a compressible drain bed, and follows a sloping terrain. The wall component is shown in part with planted soils banked against it, and employs many of the standard features of a cementitious foundation wall.

Figure 6:
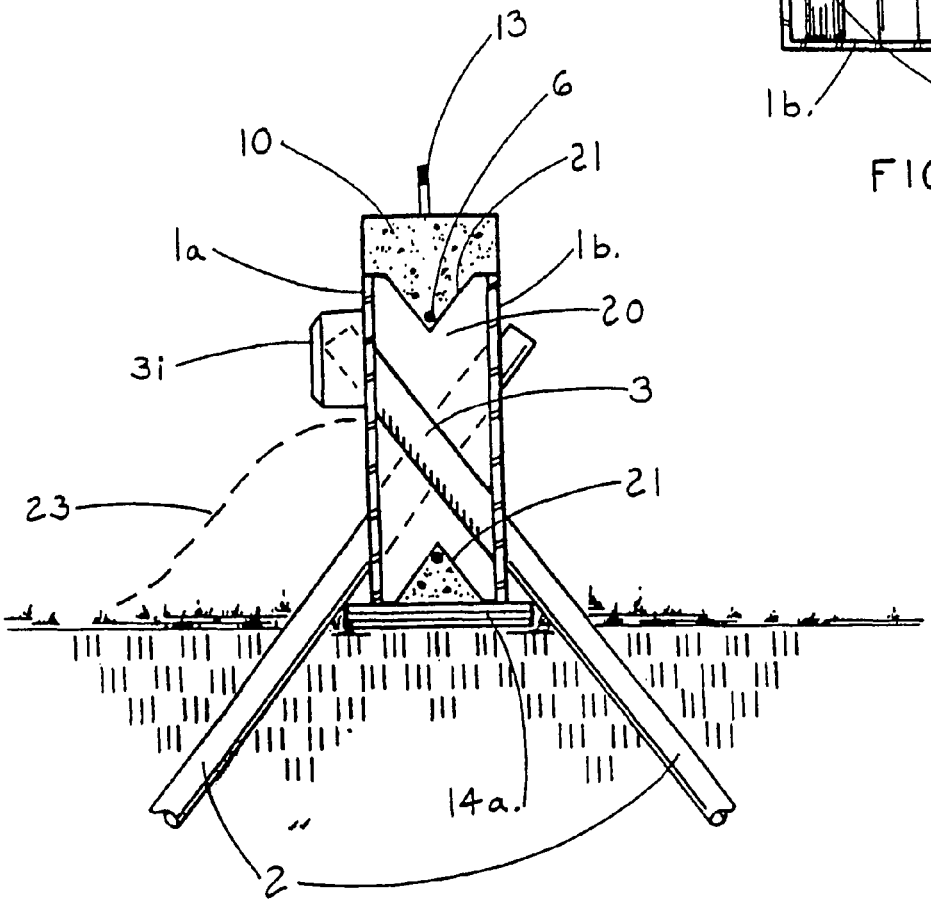

FIG. 6 is a cross-sectional view of the second embodiment depicting a completed foundation assembly.

Figure 7:
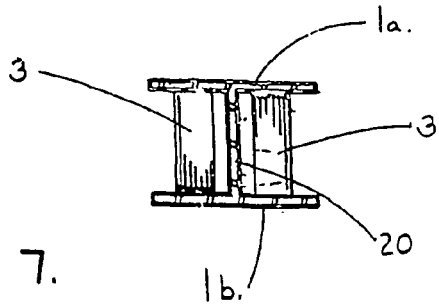

FIG. 7 is a top view of the second embodiment depicting the footing component.

Figure 8:
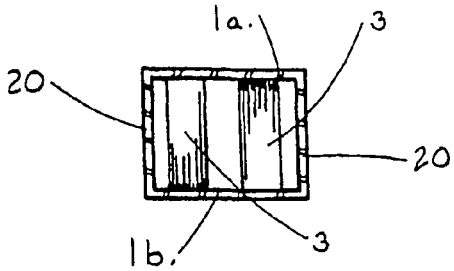

FIG. 8 is a top view of the second embodiment depicting a variation of the footing component.

Figure 9:
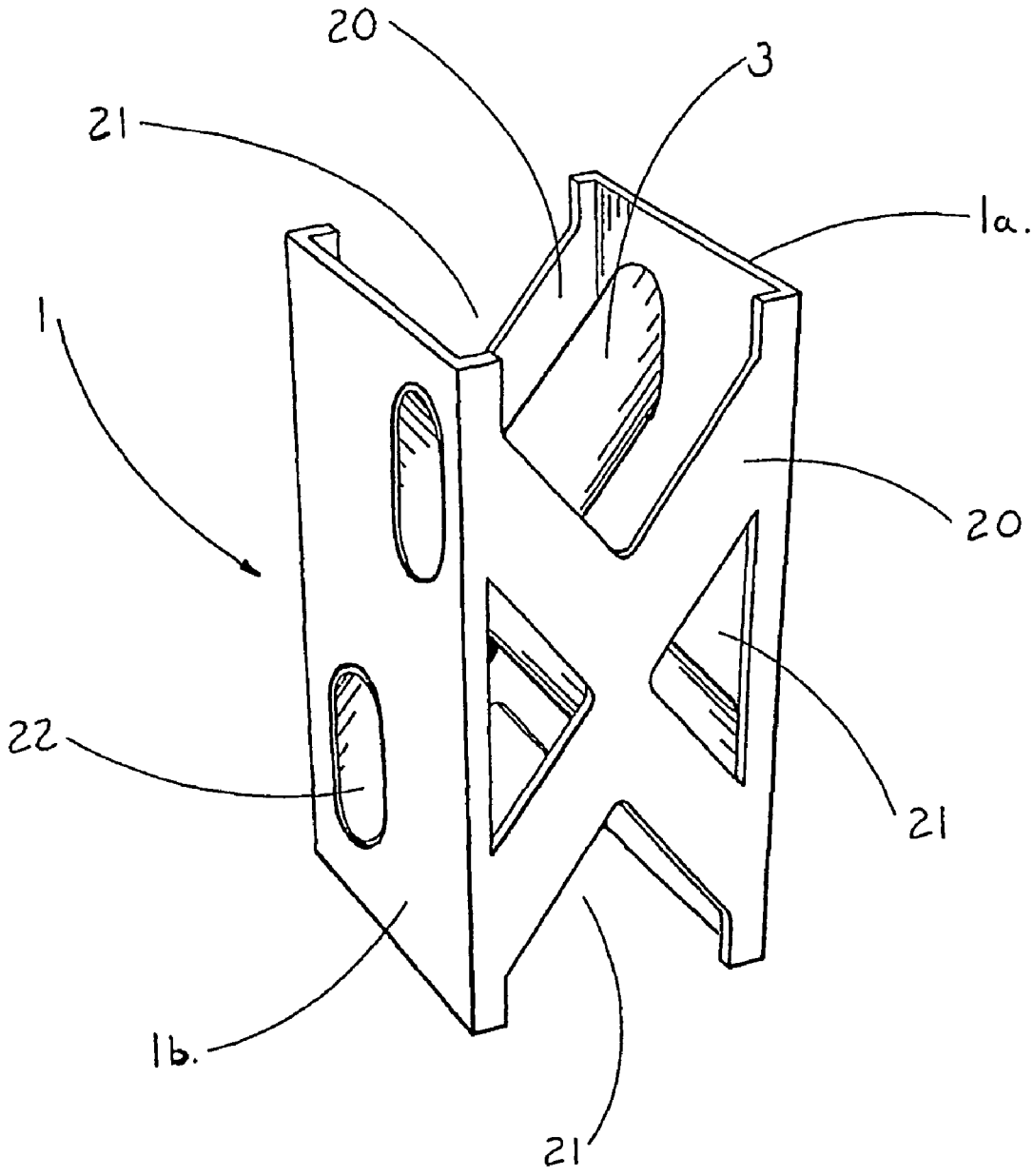

FIG. 9 is a perspective view of the second embodiment depicting the footing component of FIG. 8

DETAILED DESCRIPTIONS OF THE PREFERRED EMBODIMENTS

First briefly in overview, the present invention is directed to an improved minimal-impact foundation system. The improved invention is a structural combination that uniquely allows for the integration of pile based footing components, with the wall component of a common foundation to form a low impact system installed with little or no excavation. In the following discussion of the drawings of preferred embodiments, like numerals are used to indicate common elements provided in the various views. The words "common" or "standard" are used to indicate items, which are already used in practice by the trade and are not unique to this disclosure.

First Embodiment

Figure 1:
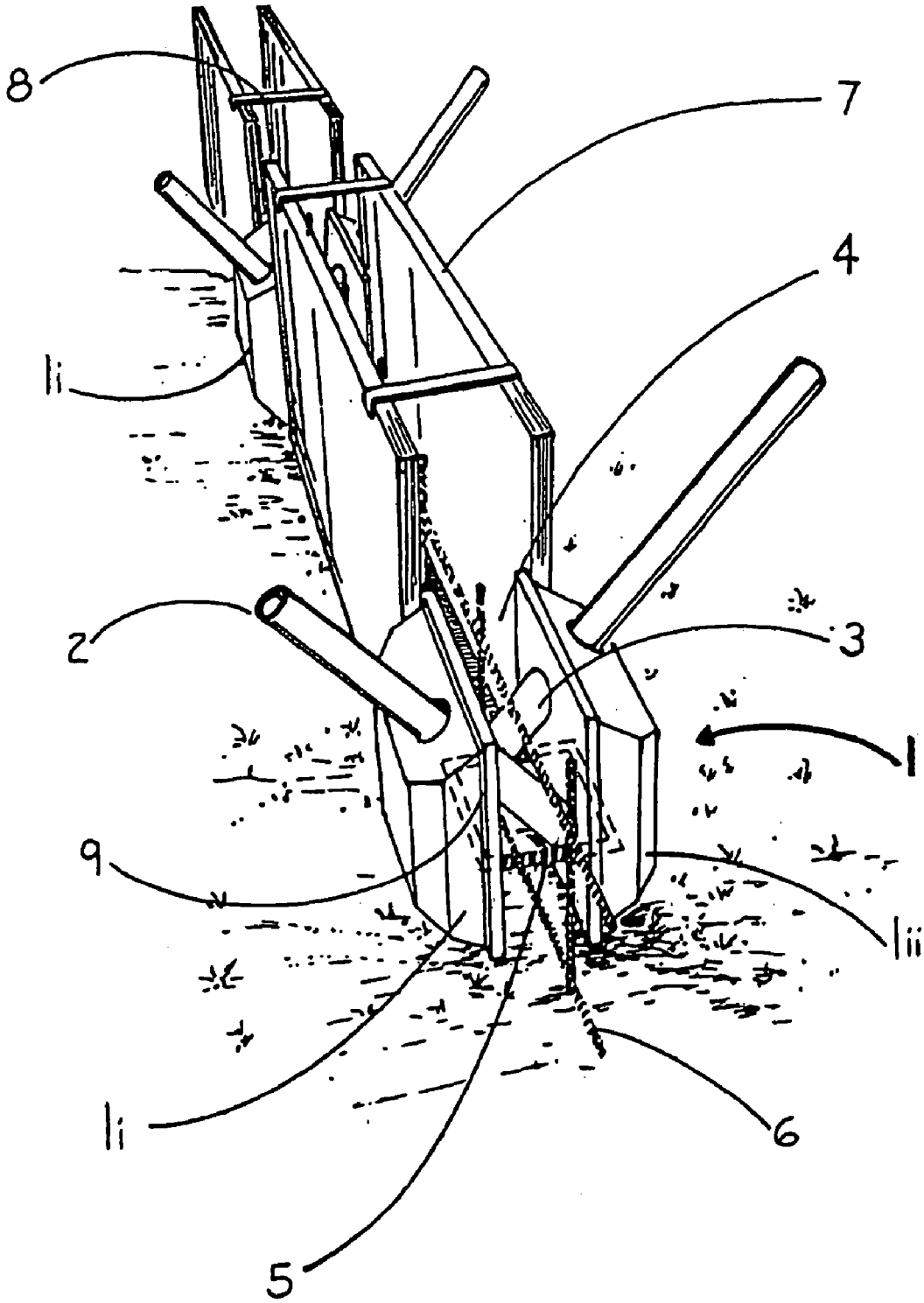
FIG. 1 is a perspective view of a first embodiment depicting a portion of the components arranged in series, and providing for the positioning of driven piles, common reinforcing grid, and standard cementitious wall forms, where the cementitious material that forms the wall has not yet been poured.

Referring now to FIG. 1, depicted is a perspective view of two of the footings arranged in series, and providing for the positioning of driven piles, reinforcing grid, and cementitious wall forms. The cementitious material that forms the traditional wall component has not yet been poured. The footing component includes two halves labeled 1*i* and 1*ii*. The separation of these halves is specific to the desired width of the subsequent wall that the component will engage. The passageway 4 that the two halves create allows for this subsequent wall to be fully engaged with the footing components. The passageway further allows for a considerable reduction in the weight of the footing component, and allows for the continuity of the reinforcing grid 6, which runs through it. In some applications, pre-cut sections of this reinforcing grid may be pre-set within the passageway by any number of fixing means prior to the placement of the footing components on site.

The footing components contain sleeves 3 located between and passing through corresponding footing halves, 1*i*, 1*ii*. The sleeves contain upper (entry) and lower (exit) openings for the placement and engagement of driven piles 2. Further, the footing components contain a reinforcing element 5, which acts to retain the lower ends of the sleeves under the spreading force of downward loads, and further acts to provide a seat for the placement of the lower horizontal members of the reinforcing grid 6.

In this figure of the preferred embodiment, the reinforcing element is comprised of a steel reinforcing bar similar to the reinforcing grid, and fashioned in a continuous hoop shape, which encircles the lower ends of the sleeves. It may, however, be any appropriate alloy, material, or shape suitable to perform its specified function. The reinforcing element 5 further provides for the rigid, pre-determined width separation of the footing halves 1*i*, 1*ii*, and also acts to improve the bond between the halves and the subsequent cementitious pour through the passageway 4.

The piles 2, shown partially driven, are utilized at this stage in the erection of the assembly to fix the footing components in their position on the terrain and relative to each other. While they are not yet providing their full structural function, they may remain in this partially driven position during the subsequent pour of the cementitious wall, or they made be fully driven prior to the pour once the wall forms 7 and their corresponding cleats 8 are set. The wall forms are positioned between the footing components and are seated against footing tabs 9 along the edges of the components. The tabs are positioned and sized to provide an appropriate spacing of the opposing forms specific to site-poured cementitious wall widths.

Other types of wall forms than those shown may be substituted in order to create the cementitious wall, and the form seat tabs may be altered to accommodate these variations. The wall forms 7 are retained from spreading at their base with the use of cleats 8, (not shown on the bottom edges of the forms), or by the placing of wooden or steel stakes along the outer lower edge of the form (not shown). For wall pours higher than the top of the footing components, (FIG. 2) metal pans are slipped in between the wall forms in the space above the components, or smaller sections of the form material are cut to size and fitted in the same location. This would prevent the subsequent cementitious material that is poured on site from oozing out over the tops of the footing components. (Pans and/or smaller form sections not shown).

The spacing of the footing components 1 is predetermined according to the structural loading requirements of the structure to be supported or retained. More particularly, for surface structures such as a building, individual footing components are placed at specific locations along the proposed structure forming a foundation perimeter that corresponds to the floor dimensions of the ensuing structure. More frequent spacing will result in a higher load capacity. Similarly, the diameter and length of the driven piles will affect the capacity of the system in a variety of soil types—larger diameter and/or longer piles having greater capacity. In combination, the footing components and the driven piles replace the traditional footing of a standard foundation and eliminate the need for digging. The assembly, as shown, is set at grade without excavation.

Figure 2:
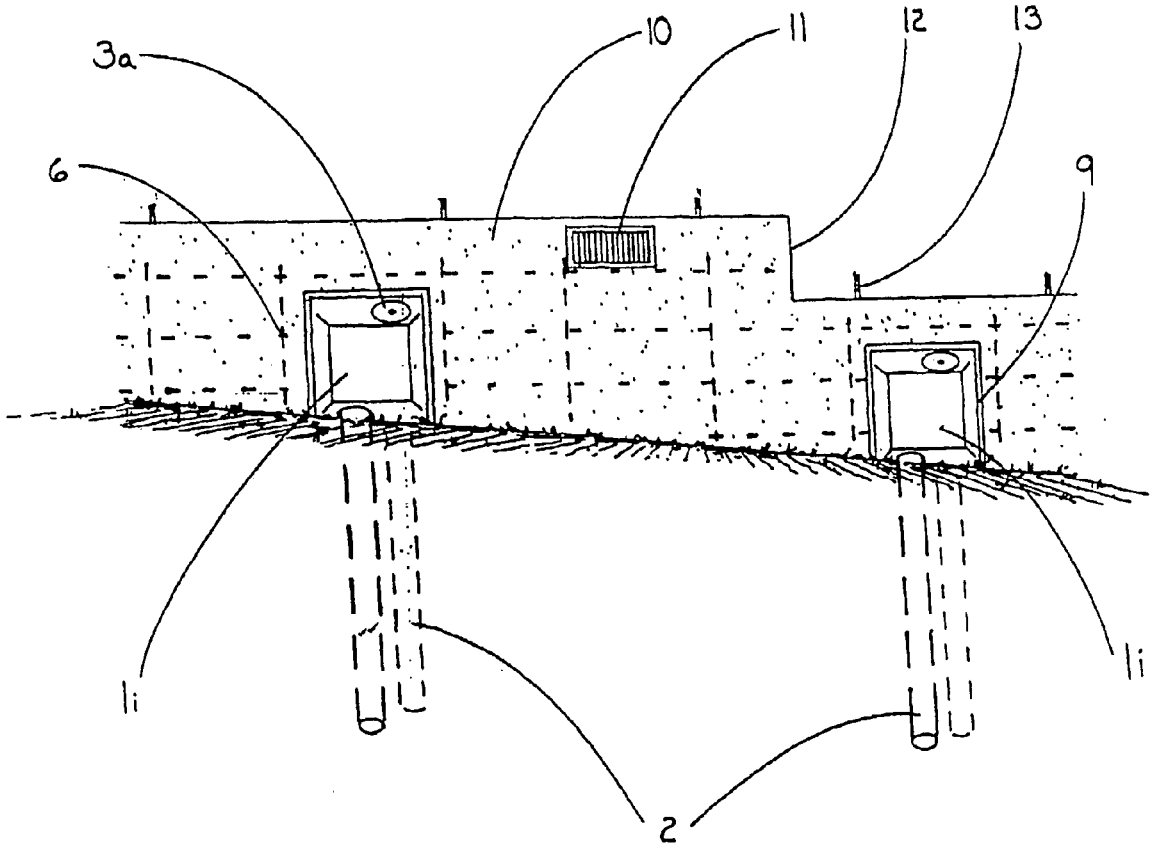
FIG. 2 is a front view of the first embodiment depicting a portion of the assembly of FIG. 1 fully integrated with the piles fully driven, and the wall cast and its forms removed. The completed foundation assembly follows a sloping terrain, and the wall employs many standard features of a traditional cementitious foundation wall.

FIG. 2 shows a front view of a portion of the preferred assembly now fully integrated with the piles fully driven and the engaged cementitious wall cast and its forms removed. The footing elements 1*i*, 1*ii* are now an integral part of the site poured cementitious wall 10, which will not transfer loads from the structure above to the soft loose soils at grade directly below it, but instead, will transfer its loads to the footings. The wall spans from footing to footing, and is engaged with each footing via the reinforcing grid 6 and the continuity of the poured cementitious material.

The completed foundation assembly follows a sloping terrain, and the wall component provides many of the desirable features of a traditional cementitious foundation. The top of the wall is level in relation to the sloping ground, and a step down 12 is utilized. A foundation vent 11 is installed, and anchor bolts 13 are used for connecting the foundation with the framing of the structure. In fact, many of the foundation wall embedments found in current practice in the trade may be utilized as though the wall component was entirely traditional.

The components have caps 3*a*, which cover the upper openings of the embedded sleeves and their corresponding driven piles. The caps may be removed to gain access to the pile for inspection. A weakened or otherwise problematic pile may be removed and replaced via the opening in the upper end of the sleeve, and the cap replaced. This cap is made of a rubberized polymer or any suitable material.

It is preferable that the footing components be cast as a cementitious material, but other load-bearing materials are acceptable, such as metals, thermoplastics, composites, or other materials. Similarly, the traditional wall is preferably poured on site with a cementitious material, but it is possible that other materials may be used without departing from the spirit of the invention. The wall component may be pre-cast in sections, with footing components embedded prior to the setting of the pre-cast section on-site, where the driven piles are integrated in the field. Various shapes and sizes of these pre-cast wall and footing component combinations may be utilized with the present invention.

Figure 3:
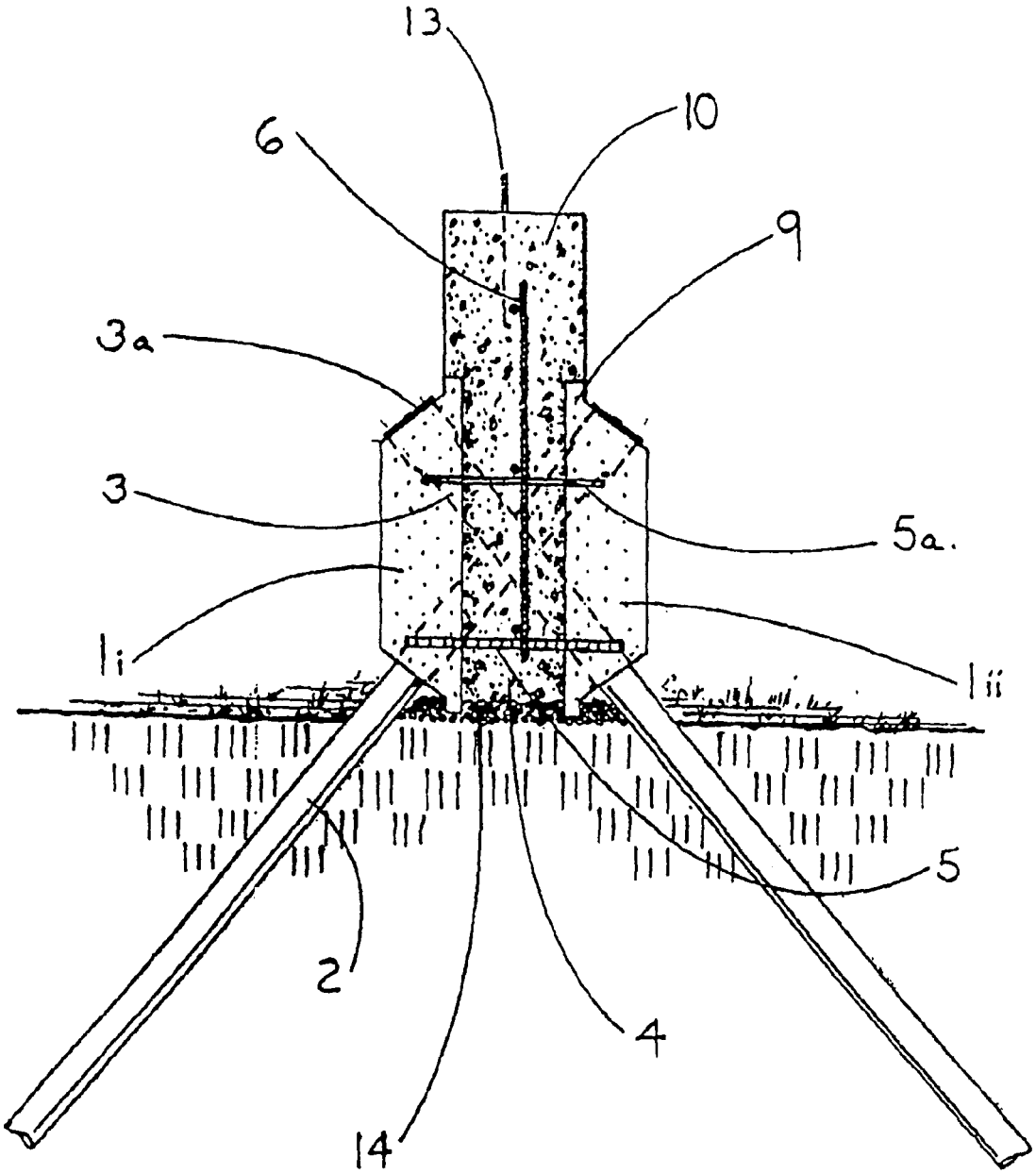
FIG. 3 is a cross-sectional view of the first embodiment depicting a completed foundation assembly.

FIG. 3 shows a cross-sectional view of the preferred completed foundation assembly. The site-poured cementitious wall 10 is shown in its position relative to the footing component halves 1*i*, 1*ii*, and their corresponding sleeves 3 and driven piles 2. The wall fills the footing component passageway 4, engages the reinforcing grid 6, and surrounds the sleeves 2, and the reinforcing element 5. An optional upper reinforcing element 5*a* is also shown, which may provide a similar function to its lower counterpart, encircling now the upper ends of the sleeves and providing an additional seat for the placement of horizontal members of the reinforcing grid. It also provides a convenient handle for carrying and positioning the component. The upper portion of the wall 10 sits above the footing component, and could be fashioned in combination with the reinforcing grid to be cast as high as the intended structure or site requires.

The sleeves 3 and their corresponding piles 2 are shown at an angle of approximately 40 degrees from vertical, but may be adjusted within a range of 20 to 80 degrees to accommodate varying driven pile configurations and/or wall widths, as varying the angle of the sleeves will alter the width of the passageway between the footing halves. The sleeves preferably have an enlarged upper end to accommodate the cap 3*a*, and this enlargement or other variations in the sleeve diameter or cross section may be incorporated to provide additional functions relative to the driven piles, or the placement of the reinforcing elements, or the caps. The piles 2 are driven into the surrounding soil such that their upper ends are in a position immediately below the protective cap 3*a*, in order to provide for easy access.

The sleeves 3 are sized according to the diameter of the driven piles 2, allowing a sliding interface with minimal play. The sleeves are preferably constructed of a substantially rigid thermoplastic material, however galvanized steel tubes, aluminum, and other alloys or composites may be substituted. In fact, an alternate arrangement is possible where the sleeves are removed during the process, leaving cavities in the cured cementitious material through which the piles may be driven. The piles are preferably galvanized steel, but may be stainless steel, other suitable alloys, ceramics or composite materials of appropriate structural character. Finally, the completed assembly is shown resting on a pea gravel bed 14. For some applications, the addition of this material allows for the free flow of site drainage in any direction underneath the foundation system. In some regions, it will also act as a compressible component, allowing frost or clay heaving soils to push upward without transferring a destructive uplifting force on the foundation. This and other suitable materials, such as common compressible cardboard, wood chips, plastics, and other materials may be used to provide this function.

EXAMPLE 1

In the invention of the first embodiment, where the site contained wooded vegetation, this vegetation was cleared with small tracked equipment and dressed or smoothed, generally within the footprint area of the home and driveway only. The area was hydroseeded immediately with the topsoil layer placed beforehand. The site was smoothed as close to the contours of the natural grade as possible, taking care that there were no low spots within the footprint of the structure that would collect water.

The next step was to mark out the foundation and lay 2" to 3" of rounded pea gravel along the outline of the house. In this example, the house included a wood framed floor over a crawl space, with an attached concrete slab floor garage. If the site had been considerably sloped, batter boards would have been erected to mark out a level and square reference. Next, the gravel was raked smooth, to about 10" wide.

According to a pre-determined plan, the footing components were placed at their required positions, with the wall form boards positioned in between. The piles were placed in the footing components and set a few inches into the soil, making sure that the sides of the footing components were plumb, and the wall forms made the proper contact with the form seat tabs. (There are raised edges on the side of the footing components, which in this example provided seats for the wall form boards.) Before the opposing wall forms were placed, #4 steel reinforcing bar was slipped inside the footing passageway, resting on the upper and lower reinforcing elements, to provide an upper and lower horizontal bar for the subsequent grid. Vertical #4 bars were then tied off at approximately sixteen inches on center, and the corners of the wall were tied and formed in a standard fashion. The opposing wall form was then added, with the bottoms of the wall forms simply staked in place, or set in form cleats, forcing the wall form against the form seat tabs. The tops of the wall forms were held with standard cleats. Had the plans required a wall higher than the top of the footing components, metal pans would have been slipped in between the wall forms in the space above the footing components, and additional wall forms could then be added with more rebar, and conventional form ties, shoes, and cleats. A level line was then snapped inside the forms, marking an intended limit to the top of the cementitious pour, and step-downs, buck-outs, anchor bolting, and hold-downs were all prepared for embedment.

At this point the inspector was provided with the opportunity to test the take-up in the piles, and inspect the bar and forming.

Next, the wall was poured, and the piles driven the following week. However, the piles could have been driven first and then the wall poured, or vise versa. The first option would have been faster for construction time, but the driving process can tweak the wall forms out of alignment in certain soils. Once the piles were driven flush with the tops of the sleeves, rubber caps were set in place over the upper ends of the piles and secured to the sleeves with an appropriate adhesive. Tie piles used were galvanized steel, but could have been stainless steel, or any suitable alloy or composite material.

Framing could proceed as soon as the wall forms were stripped, with no drainage systems having to be installed, or backfill to wait for, because surface and subsurface water is allowed to flow through the site, under the foundation system through the crawlspace soils, and out the downhill side, uninterrupted. When trenching for utilities parallel to the structure, care was taken to dig a sufficient distance away from the embedded piles, and to turn toward the house in between the footing components.

The garage slab was then poured over 6" of compacted sand or pit run, and a plastic vapor barrier utilized. Care was taken with the drainage in this area so that water did not creep under the slab, the same way it is allowed to in the crawl space.

The poured wall was approximately 18" high. Depending on the site drainage and the landscaping needs, additional bark or well drained topsoil was brought to the site and banked against the foundation.

Second Embodiment

FIG. 4 shows a perspective view of two of the footing components arranged in series, and providing for the positioning of driven piles, reinforcing bars and cementitious wall forms. The footing component 1 is comprised of two faceplates labeled 1*a* and 1*b*. The separation of these faceplates is specific to the desired width of the subsequent wall that the component will engage, and fixed by the size and shape of an interior plate 20, preferably substantially perpendicular to the faceplates. This interior plate may take many shapes while providing the same function, and more than one interior plate may be used to fix the faceplates (FIG. 8). The shape of the interior plate shown in the preferred embodiment provides wide, upper and lower notched areas 21 which allow for the placement of a continuous longitudinal reinforcing bar. These notches also allow for the free flow of cementitious material in and around the footing component 1. The upper and lower notches are shown as the same shape (though inverted with respect to each other), but they may each be of a distinct shape as the design for their function dictates. The components contain sleeves 3 located between and fixed in corresponding openings 22, in faceplates, 1*a*, 1*b*. The sleeves 3 and their corresponding openings 22, provide upper (entry) and lower (exit) openings for the placement and engagement of driven piles (FIGS. 5 & 6). The wall forms 7, and their corresponding cleats 8, are set on a compressible drain bed 14*a*. This bedding may be set on level or sloping ground, and in some applications allows for the free flow of site drainage. In some regions this bedding will also act as a buffer between the base of the foundation wall and heaving frost or clay soils, minimizing their destructive uplifting force on the foundation. The wall forms enclose the footing components, seating specifically against the faceplates, which are in turn appropriately spaced to match the cementitious wall width. However, other types of wall forms than those shown may be substituted in order to create the cementitious wall, and the footing component may be altered as necessary to accommodate these variations.

The spacing of the footing components along the length of the wall is predetermined according to the structural loading requirements of the structure to be supported or retained. More particularly, for surface structures such as a building, individual footing components are spaced along the proposed structure forming a foundation perimeter that corresponds to the floor dimensions of the ensuing structure. Increasing the number of footing components will result in a higher load capacity. Similarly, the diameter and length of the driven piles will affect the capacity of the system in a variety of soil types, with larger diameter and/or longer piles having greater capacity. The footing of the present invention combines the footing components and the driven piles to replace the footing of a standard foundation and eliminates the need for digging. The assembly shown is set on a minimally prepared site, without any or with only minimal excavation, and combined with adjoining like assemblies forms a continuous foundation perimeter.

FIG. 5 shows a front view of a portion of the assembly now fully integrated with the piles fully driven, and the engaged cementitious wall cast and its forms removed. The footing components 1 are now an integral part of the cementitious wall 10. In combination with the now fully driven piles 2, the footing components comprise the base-load bearing elements of the foundation system. The wall 10 will not transfer loads from the structure above to the soft loose soils at grade directly below it, but instead, will transfer its loads to the integrated footing components and their corresponding piles. The wall spans footing component to footing component, and is engaged with each via the reinforcing grid 6 and the continuity of the poured cementitious material.

The depicted completed foundation assembly follows a sloping terrain, and is resting on a compressible drain bed 14*a*. The top of the wall is level in relation to the sloping ground, and a step down 12 is utilized, as well as anchor bolts 13 for connecting the foundation to the framing of the structure. In addition, many of the common foundation wall embedments found in current practice in the trade may be utilized, appearing as though the wall component was entirely traditional.

The footing components have caps 3*i*, which cover the upper end of the driven piles. The caps may be removed to gain access to the pile for inspection. These caps are shown just above planted soils 23 that have been banked against the wall on the outside of the structure for aesthetic appeal. A weakened or otherwise problematic pile may be removed and replaced via the opening in the upper end of the sleeve, and the cap replaced.

This cap may be made of formed cement, a rubberized polymer, formed or cast metal, or any other suitable material. Manipulations of the faceplate, its openings and/or the upper ends of the sleeves may be made to accommodate different shaped caps or those which feature specialized connections to the footing component.

The footing components are preferably galvanized steel, but various other load bearing materials are acceptable, such as aluminum, other alloy metals, injection molded thermoplastics, composites or other materials. Similarly, the wall is preferably poured on site with a cementitious material, but it is possible that other materials may be used without departing from the spirit of the invention. The wall component may be pre-cast in sections, with footing components embedded prior to the setting of the pre-cast section onsite, where the driven piles are integrated in the field.

FIG. 6 shows a cross-sectional view of the completed foundation assembly. The cementitious wall 10 is shown in its position relative to the footing component's faceplates 1*a*, 1*b*, and their corresponding sleeves 3 and driven piles 2. The wall flows though the upper and lower notches 21 and engages the reinforcing bar 6. It further surrounds the sleeves 3 and interior plate 20. The upper portion of the wall 10 sits above the footing component, and could be fashioned in combination with the reinforcing grid to be cast as high as the intended structure or site requires.

The sleeves 3 and their corresponding piles 2 are shown at an angle of approximately 40 degrees from vertical, but may be adjusted within a range of 20 to 80 degrees to accommodate varying driven pile configurations and/or wall widths. The piles 2 are driven into the surrounding soil such that their upper ends are in a position immediately below the protective cap 3*i*. The wall may have planted soils 23 banked against it as an aesthetic preference.

The sleeves 3 are sized according to the diameter of the driven piles 2, allowing a sliding interface with minimal play. The sleeves are preferably constructed of rigid thermoplastic, but galvanized steel tubes, aluminum, cardboard and other alloys or composites may be substituted. The sleeve may also be removed during the process, leaving cavities in the cured cementitious material through which the piles may be driven. The piles are preferably galvanized steel, but may be stainless steel, other suitable alloys, ceramics or composite materials of appropriate structural character. Finally the completed assembly is shown resting on the compressible drain bed 14*a*. The bedding material is preferably made of a layered, corrugated plastic, but other materials may be substituted. As described above, for some applications, the addition of this bed material allows for the free flow of site drainage underneath the foundation system. In some regions it will also act as a compressible component, allowing frost or clay heaving soils to push upward without transferring a destructive uplifting force on the foundation. Many other suitable materials may be used to provide this function.

FIG. 7 is a top view of the footing component with sleeves 3, faceplates 1*a*, 1*b*, and interior plate 20.

FIGS. 8 and 9 depict an alternate configuration of the footing component. This configuration includes substantially all of the same parts of the previous configuration, such as sleeves 3, openings 22, and faceplates 1*a*, 1*b*. The difference is that this configuration includes two plates 20. The inclusion of two plates provides the footing component with added strength, which is preferable in structures requiring greater support. Each of these plates is substantially the same as the one in the single plate configuration (FIGS. 4–7), with each preferably including upper and lower notches 21. Another option can enlist additional notches or cutouts (FIG. 9), which provide for improved integration with the cementitious material of the foundation.

EXAMPLE 2

In the invention of the second embodiment, where the site contained wooded vegetation, this vegetation was cleared with small tracked equipment and dressed or smoothed, generally within the footprint area of the home and driveway only. The site was terraced with minimal vertical breaks to keep as close to the contours of the natural grade as possible, taking care that there were no low spots within the crawl space that would collect water. As in Example 1, the area was hydroseeded immediately with the topsoil layer placed beforehand.

The next step was to mark out the foundation and lay a compressible drain bedding along the outline of the house. In this example, the house included a wood framed floor over a crawl space, with an attached concrete slab floor garage. If the site had been considerably sloped, batter boards would be erected to mark out a level and square reference.

According to a pre-determined plan, the footing components were placed at their required positions, and horizontal reinforcing steel was set, using the upper and lower notches of the footing component as guides. Vertical reinforcing bars were then tied off at approximately sixteen inches on center, and the corners of the wall were tied and formed in a standard fashion. The wall forms were then added, with the bottoms of the wall forms simply staked in place or set in form cleats, while the tops of the wall forms were held with form cleats. Had the plans required a wall higher than the height of a single tier of forms, then additional wall forms could be added above with more rebar, and conventional form ties, shoes, and cleats. A level line was then snapped inside the forms, marking an intended limit to the top of the cementitious pour, and step-downs, buck-outs, anchor bolting, and hold-downs were all prepared for embedment.

At this point an inspector was provided with the opportunity to inspect the bar and forming, and conduct any preliminary testing of soil/pile relationships, outside of the erected forms.

Next the wall was poured, and the piles driven the following week. Once the piles are driven just to the tops of the sleeves, the caps are set in place over the upper ends of the piles and secured with a mortar or appropriate adhesive. The piles are preferably galvanized steel, but may be stainless steel, or any suitable alloy or composite material.

Framing could proceed as soon as the wall forms were stripped, with no drainage systems having to be installed, or backfill to wait for, because surface and subsurface water is allowed to flow through the site, under the foundation system through the crawlspace soils, and out the downhill side uninterrupted. When trenching for utilities parallel to the structure, care was taken to dig a sufficient distance away from the embedded piles, and to turn toward the house in between the footing components.

The garage slab was then poured over 6" of compacted sand or pit run, and a plastic vapor barrier utilized. Care was taken with the drainage in this area so that water did not creep under the slab, the same way it is allowed to in the crawl space. Once a 1.5" wooden sill was added, a height of 16.5" for the poured wall resulted in a crawl space height of 18". Depending on the site drainage and the landscaping needs, additional bark or well-drained topsoil was brought to the site and banked against the foundation.

Although the invention has been described in detail for the purpose of illustration, it is to be understood that such detail is solely for that purpose and that variations can be made by those skilled in the art without departing from the spirit and scope of the invention.

What is claimed is:

1. A footing for use in constructing a foundation for a structure, comprising:

a. a footing component having:

i. a first vertical wall, including at least one passageway;

ii. a second vertical wall, including at least one passageway, wherein said second wall is spaced from and substantially parallel to said first wall; and iii. a connector, for connecting said first wall and said second wall, so as to enhance positional retention of said first wall and said second wall and to provide at least one space between said first wall and said second wall for accommodating foundation material; and b. at least one pile, for being driven into the ground through said at least one passageway of said first wall and/or said at least one passageway of said second wall;

further comprising at least one reinforcing sleeve for said at least one passageway of said first wall and/or said at least one passageway of said second wall; and wherein said at least one pile and said at least one reinforcing sleeve are positioned at an angle of approximately 20 to 80 degrees from vertical.

2. A footing for use in constructing a foundation for a structure, comprising:

a. a footing component having:

i. a first vertical wall, including at least one passageway;

ii. a second vertical wall, including at least one passageway, wherein said second wall is spaced from and substantially parallel to said first wall; and iii. a connector, for connecting said first wall and said second wall, so as to enhance positional retention of said first wall and said second wall and to provide at least one space between said first wall and said second wall for accommodating foundation material; and b. at least one pile, for being driven into the ground through said at least one passageway of said first wall and/or said at least one passageway of said second wall;

further comprising at least one reinforcing sleeve for said at least one passageway of said first wall and/or said at least one passageway of said second wall; and wherein said at least one pile and said at least one reinforcing sleeve are positioned at an angle of approximately 40 degrees from vertical.

3. A footing for use in constructing a foundation for a structure, comprising:

a. a footing component having:

i. a first vertical wall, including at least one passageway;

ii. a second vertical wall, including at least one passageway, wherein said second wall is spaced from and substantially parallel to said first wall; and iii. a connector, for connecting said first wall and said second wall, so as to enhance positional retention of said first wall and said second wall and to provide at least one space between said first wall and said second wall for accommodating foundation material; and b. at least one pile, for being driven into the ground through said at least one passageway of said first wall and said at least one passageway of said second wall; and wherein said connector includes at least one plate connected to said first vertical wall and said second vertical wall.

4. The footing of claim 3, wherein said at least one plate is substantially perpendicular to said first vertical wall and said second vertical wall.

5. The footing of claim 4, wherein said at least one plate includes an upper notch and/or a lower notch, so as to provide for free flow of foundation material and/or placement of at least one continuous longitudinal wall-reinforcing bar.

6. The footing of claim 3, wherein said at least one plate is a vertical wall.

7. The footing of claim 3, wherein said at least one plate is a vertical wall substantially perpendicular to said first vertical wall and said second vertical wall.

8. The footing of claim 3, further comprising at least one sleeve for said at least one passageway of said first wall and/or said at least one passageway of said second wall.

9. A footing for use in constructing a foundation for a structure, comprising:

a. a footing component having:

i. a first vertical wall, including at least one passageway;

ii. a second vertical wall, including at least one passageway, wherein said second wall is spaced from and substantially parallel to said first wall; and iii. a connector, for connecting said first wall and said second wall, so as to enhance positional retention of said first wall and said second wall and to provide at least one space between said first wall and said second wall for accommodating foundation material; and b. at least one pile, for being driven into the ground through said at least one passageway of said first wall and said at least one passageway of said second wall;

wherein said connector includes two plates connected to said first vertical wall and said second vertical wall.

10. The footing of claim 9, wherein at least one of said plates is substantially perpendicular to said first vertical wall and said second vertical wall.

11. The footing of claim 10, wherein at least one of said plates include at least one notch and/or cutout, so as to provide for free flow of foundation material and/or placement of at least one continuous longitudinal wall-reinforcing bar.

12. The footing of claim 9, wherein at least one of said plates is a vertical wall.

13. The footing of claim 9, wherein at least one of said plates is a vertical wall substantially perpendicular to said first vertical wall and said second vertical wall.

14. A footing for use in constructing a foundation for a structure, comprising:

a. a footing component having:

i. a first vertical wall, including at least one passageway;

ii. a second vertical wall, including at least one passageway, wherein said second wall is spaced from and substantially parallel to said first wall; and iii. a connector, for connecting said first wall and said second wall, so as to enhance positional retention of said first wall and said second wall and to provide at least one space between said first wall and said second wall for accommodating foundation material; and b. at least one pile, for being driven into the ground through said at least one passageway of said first wall and said at least one passageway of said second wall;

wherein said at least one pile includes a first pile, for being driven into the ground, and a second pile, for being driven into the ground; and wherein said first pile and said second pile are positioned at an angle of approximately 20 to 80 degrees from vertical.

15. The footing of claim 14, wherein said first pile and said second pile are positioned at an angle of approximately 40 degrees from vertical.

16. A footing for use in constructing a foundation for a structure, comprising:

a. a footing component having:

i. a first vertical wall, including at least one passageway;

ii. a second vertical wall, including at least one passageway, wherein said second wall is spaced from and substantially parallel to said first wall; and iii. a connector, for connecting said first wall and said second wall, so as to enhance positional retention of said first wall and said second wall and to provide at least one space between said first wall and said second wall for accommodating foundation material; and b. at least one pile, for being driven into the ground through said at least one passageway of said first wall and/or said at least one passageway of said second wall; and wherein said at least one passageway of said first vertical wall includes a first bore and a second bore, and said at least one passageway of said second wall includes a third bore and a fourth bore; and wherein said at least one pile includes a first pile, for being driven into the ground through said first bore and said third bore, and a second pile, for being driven into the ground through said second bore and said fourth bore.

17. A method of constructing a foundation, comprising the steps of:

a. placing, at a predetermined position, at least one footing component having a first vertical wall, and a second vertical wall spaced, connected, and parallel to said first vertical wall;

b. stabilizing said at least one footing component at said predetermined position;

c. placing and stabilizing wall forms about said at least one footing component, so as to create a space;

d. pouring of foundation material into said space; and e. driving at least one pile into the ground through said first vertical wall and/or said second vertical wall;

wherein said at least one pile is positioned at an angle of approximately 20 to 80 degrees from vertical prior to driving said at least one pile into the ground.

18. The method of claim 17, wherein said at least one pile is positioned at an angle of approximately 40 degrees from vertical prior to driving said at least one pile into the ground.

19. The method of claim 17, wherein said at least one pile includes a first pile and a second pile.

20. The method of claim 19, wherein said first pile is driven into the ground through said first vertical wall and said second vertical wall, and said second pile is driven into the ground through said second vertical wall and said first vertical wall.

21. A footing for use in constructing a foundation for a structure, comprising:

a. a footing component having, a first vertical wall, including a first bore and a second bore, a second vertical wall, including a third bore and a fourth bore, and wherein said second wall is spaced from and substantially parallel to said first wall, a first sleeve positioned between said first bore and said fourth bore, a second sleeve positioned between said second bore and said third bore, and a connector including at least one plate, for connecting said first wall and said second wall so as to enhance positional retention of said first wall and said second wall, and to provide at least one space between said first wall and said second wall for accommodating foundation material and reinforcement;

b. a first pile, for being obliquely driven into the ground through said first bore, said first sleeve, and said fourth bore; and c. a second pile, for being obliquely driven into the ground through said second bore, said second sleeve, and said third bore.

22. The footing of claim 21, wherein said connector includes two plates connected to said first vertical wall and said second vertical wall.

23. The footing of claim 22, wherein at least one of said plates is substantially perpendicular to said first vertical wall and said second vertical wall.

24. The footing of claim 22, wherein at least one of said plates is a vertical wall.

25. The footing of claim 23, wherein at least one of said plates include at least one notch and/or cutout, so as to provide for free flow of foundation material and/or placement of at least one continuous longitudinal wall-reinforcing bar.

26. The footing of claim 22, wherein at least one of said plates is a vertical wall substantially perpendicular to said first vertical wall and said second vertical wall.

27. The footing of claim 21, further comprising a cap for at least one of said first bore, said second bore, said third bore, and said fourth bore, so as to accommodate inspection and/or removal and/or replacement of at least one of said first pile and said second pile.

28. A method of constructing a foundation, comprising the steps of:

a. smoothing a site;

b. marking out an outline of the foundation of a structure;

c. placing compressible drain bedding along said outline;

d. placing, at predetermined positions, a predetermined number of footing components having a first vertical wall, and a second vertical wall spaced, connected, and parallel to said first vertical wall;

e. stabilizing said predetermined number of footing components, at said predetermined positions;

f. placing reinforcement bars in and between said predetermined number of footing components;

g. placing wall forms about said predetermined number of footing components, and pouring foundation material; and h. obliquely driving piles into the ground through said predetermined number of footing components.

* * * * *